US008636481B2

(12) United States Patent
Liu

(10) Patent No.: US 8,636,481 B2
(45) Date of Patent: Jan. 28, 2014

(54) EMBEDDED BUILT-IN AIR PUMP

(75) Inventor: Ying'an Liu, Guangdong (CN)

(73) Assignee: Dong Guan Hua Tao Metal & Plastic Products Co., Ltd., Guandong (CN)

( * ) Notice: Subject to any disclaimer, the term of this patent is extended or adjusted under 35 U.S.C. 154(b) by 90 days.

(21) Appl. No.: 13/254,916

(22) PCT Filed: Dec. 17, 2010

(86) PCT No.: PCT/CN2010/079923

§ 371 (c)(1),
(2), (4) Date: Sep. 6, 2011

(87) PCT Pub. No.: WO2011/124079

PCT Pub. Date: Oct. 13, 2011

(65) Prior Publication Data

US 2012/0107153 A1 May 3, 2012

(30) Foreign Application Priority Data

Apr. 7, 2010 (CN) ..... 2010 2 0157508 U

(51) Int. Cl.

| | |
|---|---|
| ***F04B 17/00*** | (2006.01) |
| ***F04B 35/04*** | (2006.01) |
| ***F04B 7/00*** | (2006.01) |
| ***F04B 39/08*** | (2006.01) |
| ***F16K 47/00*** | (2006.01) |
| ***F16K 31/02*** | (2006.01) |
| ***F16K 31/44*** | (2006.01) |
| ***F16L 55/02*** | (2006.01) |

(52) U.S. Cl.

USPC ..... 417/410.1; 417/505; 251/123.3; 251/129.03; 251/263

(58) Field of Classification Search

USPC ..... 5/173; 417/410.1, 505; 251/262, 263, 251/129.11

See application file for complete search history.

(56) References Cited

U.S. PATENT DOCUMENTS

| | | | | |
|---|---|---|---|---|
| 4,538,559 | A * | 9/1985 | Imamura et al. | 123/90.6 |
| 6,299,420 | B1 * | 10/2001 | Saputo et al. | 417/527 |
| 6,679,686 | B2 * | 1/2004 | Wang | 417/423.1 |
| 6,733,254 | B1 * | 5/2004 | Yen | 417/423.1 |

(Continued)

FOREIGN PATENT DOCUMENTS

| | | |
|---|---|---|
| CN | 2198205 | 5/1995 |

OTHER PUBLICATIONS

International Search Report for PCT/CN2010/079923 dated Mar. 17, 2011.

*Primary Examiner* — Devon Kramer
*Assistant Examiner* — Lilya Pekarskaya
(74) *Attorney, Agent, or Firm* — Pearne & Gordon LLP

(57) ABSTRACT

An automatic inflation pump including a housing, an air inlet, an air outlet provided in the housing, a manual rotary switch, a sealing device located at the air outlet, an air pump provided inside the housing and a motor for driving the air pump. The manual rotary switch is provided thereon with a dovetail groove which includes a deep groove and two shallow grooves located at both sides of the deep groove. The sealing device includes a driving stem and an air sealing plate for sealing the air outlet. One end of the driving stem is connected with the air sealing plate. A spring is provided on the driving stem. One end of the spring is fixed on a free end of the driving stem and the other end of the spring is supported at the air outlet.

9 Claims, 3 Drawing Sheets

(56) References Cited

U.S. PATENT DOCUMENTS

| | | | | |
|---|---|---|---|---|
| 7,571,500 | B2 * | 8/2009 | Wu | 5/173 |
| 2005/0125904 | A1 * | 6/2005 | Tsai | 5/713 |
| 2010/0247337 | A1 * | 9/2010 | Tsai | 417/239 |
| 2010/0247355 | A1 * | 9/2010 | Pan | 417/423.14 |
| 2010/0247356 | A1 * | 9/2010 | Tsai | 417/423.14 |
| 2011/0061169 | A1 * | 3/2011 | Liu et al. | 5/710 |

* cited by examiner

EMBEDDED BUILT-IN AIR PUMP

The present application is the national phase of International Application No. PCT/CN2010/079923, titled "AUTOMATIC INFLATION PUMP", filed on Dec. 17, 2010, which claims the benefit of priority to Chinese patent application No. 201020157508.X titled "AUTOMATIC INFLATION PUMP", filed with the Chinese State Intellectual Property Office on Apr. 7, 2010. The entire disclosure thereof is incorporated herein by reference.

TECHNICAL FIELD OF THE INVENTION

The present invention relates to a technical field of air pumping and compression device, particularly to an electric-automatic inflation pump.

BACKGROUND OF THE INVENTION

An automatic inflation pump installed in an inflatable object (for example an automatic inflatable cushion) is provided with an air outlet which needs to be opened while inflating so that the automatic inflation pump can fill the inner chamber of the inflatable object with air and needs to be closed after inflation is finished so as to prevent the air in the inflatable object from leaking out.

In the prior art, the air outlet of the automatic inflation pump usually employs a self-sealing silicone rubber air sealing opening, i.e. using a check valve at the air outlet. The air sealing opening with this structure has some advantages, for example, being simple in structure and being easy to use. While inflating, the self-sealing silicone rubber air sealing opening is pushed to open under the air pressure of the automatic inflation pump so as to achieve the inflation action, and is automatically closed after inflation is finished.

However, the self-sealing silicone rubber air sealing opening has a disadvantage of short service life. The performance of the self-sealing silicone rubber air sealing opening relies on the properties of silicone rubber. After using for a period, the silicone rubber of the self-sealing silicone rubber air sealing opening in the prior art would be degraded and its self-sealing performance becomes worse which causes that the self-sealing silicone rubber air sealing opening cannot be closed completely and that air leakage of the inflatable object often occurs. On the other hand, after using for a period, the self-sealing silicone rubber air sealing opening may be covered with dust, impurities, etc, which leads to air leakage due to incomplete seal between a silicone rubber air sealing surface and a plastic air sealing opening, and thus accelerates the degrading of silicone rubber of the self-sealing silicone rubber air sealing opening, and as a result, the self-sealing performance of silicone rubber becomes worse which also causes that the self-sealing silicone rubber air sealing opening cannot be closed completely.

SUMMARY OF THE INVENTION

In view of the deficiency of the prior art, the object of the present invention is to provide an automatic inflation pump in which an air outlet can be opened or closed by rotating a manual rotary switch.

In order to solve the above technical problem, the present invention provides an automatic inflation pump including a housing, an air inlet, an air outlet provided on the housing, an air pump provided inside the housing and a motor for driving the air pump. The automatic inflation pump further includes a manual rotary switch and a sealing device provided at the air outlet. The manual rotary switch is provided thereon with a dovetail groove which includes a deep groove and two shallow grooves located at both sides of the deep groove. The sealing device includes a driving stem and an air sealing plate for sealing the air outlet. One end of the driving stem is connected with the air sealing plate and the other end of the driving stem contacts the dovetail groove. When the other end of the driving stem is located in the deep groove of the dovetail groove, the air sealing plate closes the air outlet; and when the other end of the driving stem is located in the shallow groove of the dovetail groove, the air outlet is opened. A spring is provided on the driving stem, one end of which is fixed on a free end of the driving stem and the other end is supported at the air outlet.

Preferably, the manual rotary switch includes a knob lid and a ventilation cylinder located at a lower end of the knob lid and connected with the knob lid. The ventilation cylinder has a vent hole. The air inlet is disposed in an upper surface of the knob lid and communicates with the air pump via the vent hole of the ventilation cylinder.

Preferably, a panel is provided at the upper end of the housing and the knob lid is exposed above the panel.

Preferably, the automatic inflation pump further includes a wire storage trough, and the panel is provided with a power indication light and a power wire lid for covering the wire storage trough.

Preferably, the automatic inflation pump further includes a micro-switch for controlling the motor, and the micro-switch is disposed beside the ventilation cylinder. A projecting member is provided on the ventilation cylinder. When the ventilation cylinder rotates towards one side, the projecting member triggers the micro-switch.

Preferably, the dovetail groove is located at a lower end of the ventilation cylinder. An annular projecting portion is provided at the middle portion of the ventilation cylinder. The projecting member for triggering the micro-switch is disposed on the annular projecting portion. A lower bracket is fixedly installed at the upper end of the motor, and an upper bracket is fixedly installed at the upper end of the lower bracket. A cavity is formed between the upper bracket and the lower bracket. The dovetail groove of the lower end of the ventilation cylinder is located at the lower bracket, and the micro-switch and the annular projecting portion of the middle portion of the ventilation cylinder are located at the upper bracket.

Preferably, a position-holding projecting member projected upwardly is provided on an upper surface of the annular projecting portion, and at least two position-holding recesses concaved upwardly are provided on a lower surface of the panel at positions corresponding to the position-holding projecting member. These position-holding recesses are located at a circumference of a circle, and an axis of the annular projecting portion passes through a center of the circle.

Preferably, a fixing cap is sleeved on the free end of the driving stem, and the end of the spring located at the free end of the driving stem abuts against the fixing cap.

Preferably, the sealing device further includes an air sealing rubber ring and a fixing bracket for fixing the air sealing rubber ring at the outside of the air outlet, and the air sealing plate is located at the outside of the air sealing rubber ring.

Preferably, a cross-shaped frame is provided at a center of the air outlet and is connected with the air outlet, and an annular position-holding ring is provided at a center of the cross-shaped frame.

The present invention has following advantages. The manual rotary switch and the sealing device disposed at the air outlet are provided in the present invention. The dovetail groove is provided on the manual rotary switch and includes a deep groove and two shallow grooves located at both sides of the deep groove. By rotating the manual rotary switch, the driving stem of the sealing device can be located in the deep groove or the shallow grooves of the dovetail groove. When the driving stem is located in the deep groove of the dovetail groove, the air sealing plate closes the air outlet; and when the driving stem is located in either shallow groove of the dovetail groove, the air sealing plate is in an open state. Since the opening and closing of the air outlet is completely controlled manually, the user can operate the manual rotary switch flexibly so as to control the opening and closing of the air outlet. The air outlet in the present invention does not use the conventional check valve but use a new mechanical structure to achieve the opening and closing of the air outlet, thus the present invention may achieve the function of the conventional check valve and also may have better stability in operation. The present invention further has advantages such as simple operation, good sealing performance and long service life.

DETAILED DESCRIPTION OF THE INVENTION

The present invention will be further described hereinafter in conjunction with the drawings.

Figure 1:
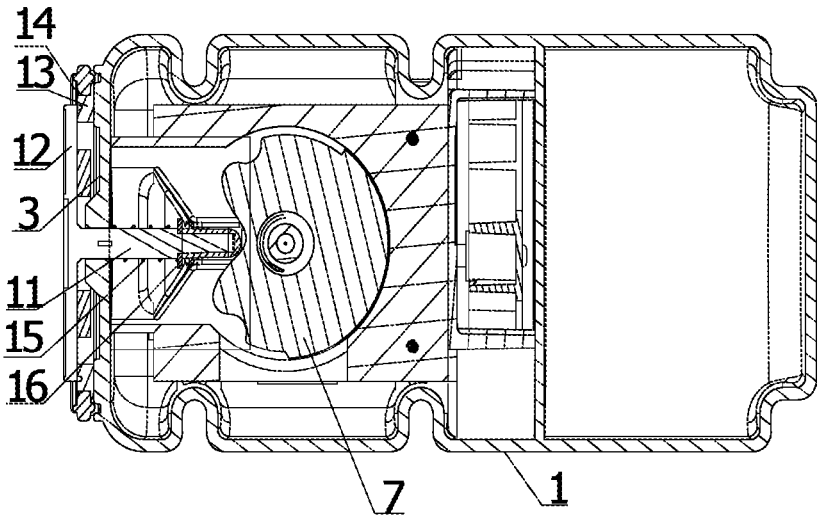
FIG. 1 is a sectional view of an automatic inflation pump according to the present invention.

Referring to FIG. 1, the present invention discloses an automatic inflation pump, including a housing 1, an air inlet 2, an air outlet 3 provided on the housing 1, an air pump 4 provided inside the housing 1 and a motor 5 for driving the air pump 4. The automatic inflation pump further includes a manual rotary switch and a sealing device provided at the air outlet 3. The manual rotary switch is provided thereon with a dovetail groove which including a deep groove 10 and two shallow grooves 101 located at both sides of the deep groove 10. The sealing device includes a driving stem 11 and an air sealing plate 12 for sealing the air outlet 3. One end of the driving stem 11 is connected with the air sealing plate 12 and the other end of the driving stem 11 contacts the dovetail groove. When the other end of the driving stem 11 is located in the deep groove 10 of the dovetail groove, the air sealing plate 12 closes the air outlet 3; and when the other end of the driving stem 11 is located in either shallow groove 101 of the dovetail groove, the air outlet 3 is opened. A spring 15 is provided on the driving stem 11. One end of the spring 15 is fixed on a free end of the driving stem 11 and the other end of the spring 15 is supported at the air outlet 3. A fixing cap 16 is sleeved on the free end of the driving stem 11, and the end of the spring 15 located at the free end of the driving stem 11 abuts against the fixing cap 16.

In operation, the operator can control the opening and closing of the sealing device by only rotating the manual rotary switch, in this way, the air outlet may be opened and closed. When the sealing device is in a closed state, the driving stem 11 is located in the deep groove 10 of the dovetail groove, and the spring 15 enables the air sealing plate 12 to press an air sealing rubber ring 13 of the air outlet 3 tightly so as to close the air outlet 3. When the air outlet 3 is closed, by rotating the manual rotary switch, the driving stem 11 will slide into the shallow groove 101 along an arc surface of the deep groove 10 of the dovetail groove. At this moment, the sealing device is in an open state, and the driving stem 11 is located in the shallow groove 101 of the dovetail groove. Thus, the shallow groove 101 pushes the driving stem 11 outwardly, and then the spring 15 is compressed. As a result, the air sealing plate 12 protrudes outwards and the air outlet 3 is opened.

Figure 2:
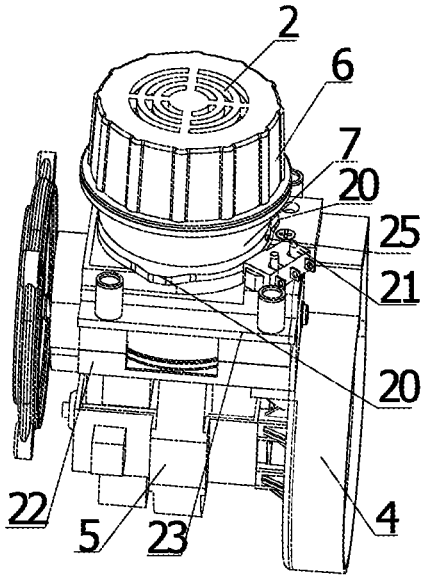
FIG. 2 is a perspective view of the internal part of the automatic inflation pump according to the present invention.

As shown in FIG. 2, the manual rotary switch includes a knob lid 6 and a ventilation cylinder 7 located at the lower end of the knob lid 6 and connected with the knob lid 6. The ventilation cylinder 7 has a vent hole 24. The air inlet 2 is disposed in the upper surface of the knob lid 6 and communicates with the air pump 4 via the vent hole 24 of the ventilation cylinder 7. The manual rotary switch may control the opening and closing of the sealing device and introducing of the air at the same time. The automatic inflation pump further includes a micro-switch 21 for controlling the motor 5. A projecting member 20 is provided on the ventilation cylinder 7. When the ventilation cylinder 7 rotates towards one side, the projecting member 20 triggers the micro-switch 21. An annular projecting portion is provided at the middle portion of the ventilation cylinder 7, and the projecting member 20 for triggering the micro-switch 21 is disposed on the annular projecting portion.

In one embodiment of the present invention, a lower bracket 22 is fixedly installed at the upper end of the motor 5, and an upper bracket 23 is fixedly installed at the upper end of the lower bracket 22. A cavity is formed between the upper bracket 23 and the lower bracket 22. The dovetail groove of the lower end of the ventilation cylinder 7 is located on the lower bracket 22, and the annular projecting portion of the middle portion of the ventilation cylinder 7 is located on the upper bracket 23. The micro-switch 21 is also installed on the upper bracket 23. In this way, when being rotated, the knob lid 6 will drive the ventilation cylinder 7 located at its lower end to rotate. When the driving stem 11 of the sealing device is located in the shallow grove 101 of the dovetail groove, the projecting member 20 on the annular projecting portion triggers the micro-switch 21 so as to start the motor 5, which enables the air pump to generate air flow at the same time when the sealing device is opened.

Of course, the annular projecting portion may be provided thereon with two projecting members 20 which are respectively located at both sides of the micro-switch 21. In this way, when rotating the manual rotary switch in a clockwise or counterclockwise direction, the projecting members 20 located at both sides of the micro-switch 21 can trigger micro-switch 21 respectively. When deflating the inflatable object, it is only needed to rotate the knob lid 6 in the opposite direction. In this way, when the air outlet 3 is opened, the micro-switch 21 is triggered, and then the air pump 4 can remove the air in the air inflation device successfully.

A position-holding projecting member 25 projected upwardly is provided on the upper surface of the annular projecting portion, and at least two position-holding recesses concaved upwardly are provided on the lower surface of a panel 17 at positions corresponding to the position-holding projecting member 25. These position-holding recesses are located at a circumference of the same circle, and an axis of the annular projecting portion passes through the center of the circle. In this way, when the manual rotary switch is rotated to the corresponding position, the position-holding projecting member 25 slides into the corresponding position-holding recess so as to fix the position of the manual rotary switch.

Figure 3:
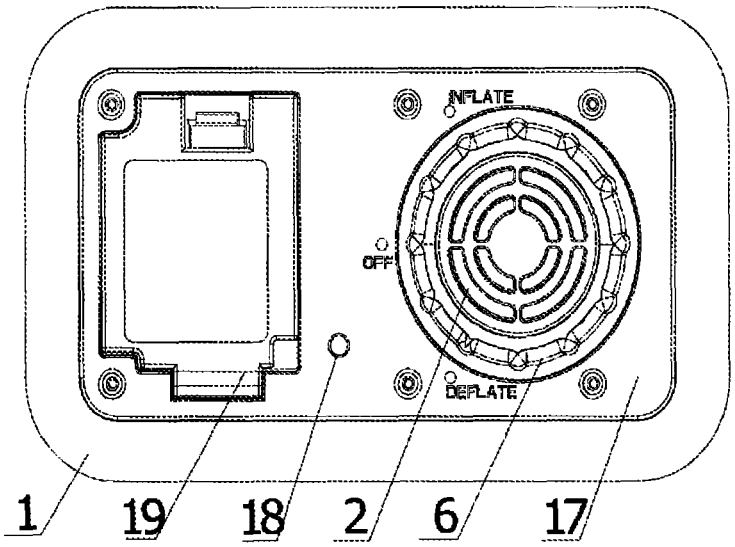
FIG. 3 is a top view of the automatic inflation pump according to the present invention.
Figure 4:
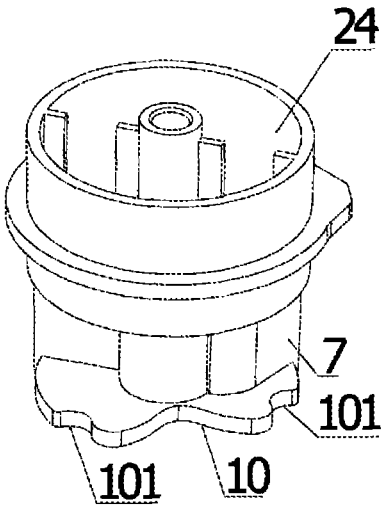
FIG. 4 is a perspective view of a ventilation cylinder of a manual rotary switch in the automatic inflation pump according to the present invention.

As shown in FIG. 3, the panel 17 is provided at the upper end of the housing 1, the knob lid 6 is exposed above the panel 17 to facilitate the operation of the user. The automatic inflation pump further includes a wire storage trough, and the panel 17 is provided thereon with a power wire lid 19 for covering the wire storage trough. In order that the operator may visually know the on/off state of power supply, a power indication light 18 is provided on the panel 17.

When the automatic inflation pump according to the present invention is energized, the power indication light 18 is lit, and then by rotating the manual rotary switch manually from "OFF" to "INFLATE", the motor 5 is started and the air outlet 3 is opened, such that air flow enters into the ventilation cylinder 7 from the air inlet 2 of the knob lid 6 and then flows into a cavity formed by the housing 1 and the motor 5 to cool the motor, and then passes through the air outlet 3 after being pressurized by the air pump 4. When the manual rotary switch points to "DEFLATE", the motor 5 is started, and the air outlet 3 is opened. The air pump 4 can draw the air in the inflatable object successfully. The drawn air first passes through the cavity formed by the housing 1 and the motor 5, then through the vent hole 24 of the ventilation cylinder 7, and finally is expelled through the air inlet 2. The lower surface of the panel 17 is provided with three position-holding recesses which are located below the positions "OFF", "INFLATE" and "DEFLATE" respectively.

Figure 5:
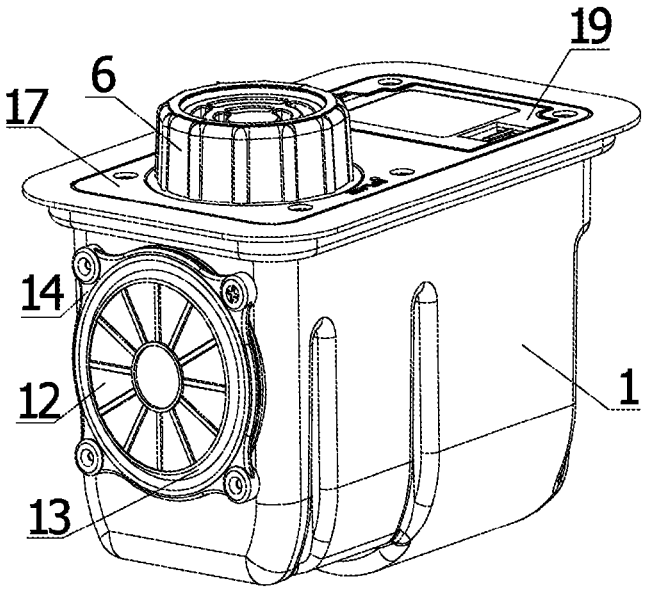
FIG. 5 is a perspective view of the automatic inflation pump according to the present invention.

As shown in FIG. 5, the sealing device further includes an air sealing rubber ring 13 and a fixing bracket 14 for fixing the air sealing rubber ring 13 at the outside of the air outlet 3. The air sealing plate 12 is located at the outside of the air sealing rubber ring 13. With this structure, the sealing device of the present invention has better sealing performance.

Figure 6:
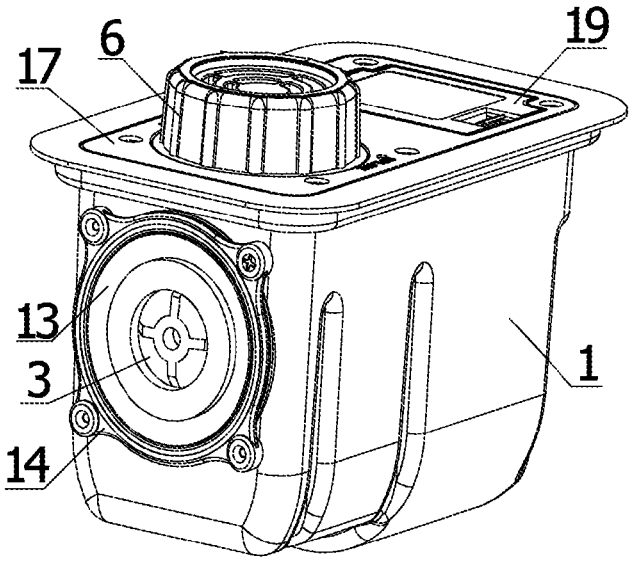
FIG. 6 is a perspective view of the automatic inflation pump with an air sealing plate and a driving stem removed according to the present invention.

FIG. 6 is a perspective view of the inflation pump after the air sealing plate 12 and the driving stem 11 are removed. As shown in FIG. 6, a cross-shaped frame is provided in the air outlet 3 and is connected with the air outlet 3, and an annular position-holding ring is provided at the center of the cross-shaped frame. The driving stem 11 of the sealing device extends inside of the housing 1 through the circular hole of the center of the annular position-holding ring.

The above description is only the specific embodiments of the present invention, and should not be deemed to limit the protection scope of the present invention. For the skilled in the art, any equivalent alternative conceived without inventive effort will fall into the protection scope of the present invention.

What is claimed is:

1. An automatic inflation pump, comprising a housing, an air inlet, an air outlet provided on the housing, an air pump provided inside the housing and a motor for driving the air pump, wherein the automatic inflation pump further comprises a manual rotary switch and a sealing device provided at the air outlet, the manual rotary switch is provided thereon with a dovetail groove having a first groove and two second grooves located at both sides of the first groove, and the first groove has a maximum depth larger than a maximum depth of the second grooves, the sealing device comprises a driving stem and an air sealing plate for sealing the air outlet, one end of the driving stem is connected with the air sealing plate and the other end of the driving stem contacts the dovetail groove, and when the other end of the driving stem is located in the first groove of the dovetail groove, the air sealing plate closes the air outlet; when the other end of the driving stem is located in either second groove of the dovetail groove, the air outlet is opened; a spring is provided on the driving stem, and one end of the spring is fixed on a free end of the driving stem and the other end of the spring is supported at the air outlet; and the manual rotary switch comprises a knob lid and a ventilation cylinder located at a lower end of the knob lid and connected with the knob lid, the ventilation cylinder has a vent hole, and the air inlet is disposed in an upper surface of the knob lid and communicates with the air pump via the vent hole of the ventilation cylinder.

2. The automatic inflation pump according to the claim 1, wherein a panel is provided at an upper end of the housing and the knob lid is exposed above the panel.

3. The automatic inflation pump according to the claim 2, wherein the automatic inflation pump further comprises a wire storage trough, and the panel is provided thereon with a power indication light and a power wire lid for covering the wire storage trough.

4. The automatic inflation pump according to claim 1, wherein the automatic inflation pump further comprises a micro-switch for controlling the motor, the micro-switch is disposed beside the ventilation cylinder, a projecting member is provided on the ventilation cylinder, and when the ventilation cylinder rotates towards one side, the projecting member triggers the micro-switch.

5. The automatic inflation pump according to the claim 4, wherein the dovetail groove is located at a lower end of the ventilation cylinder, an annular projecting portion is provided at a middle portion of the ventilation cylinder, the projecting member for triggering the micro-switch is disposed on the annular projecting portion, a lower bracket is fixedly installed at an upper end of the motor, an upper bracket is fixedly installed at an upper end of the lower bracket, a cavity is formed between the upper bracket and the lower bracket, the dovetail groove of the lower end of the ventilation cylinder is located on the lower bracket, and the micro-switch and the annular projecting portion of the middle portion of the ventilation cylinder are located on the upper bracket.

6. The automatic inflation pump according to the claim 5, wherein a position-holding projecting member projected upwardly is provided on an upper surface of the annular projecting portion, at least two position-holding recesses concaved upwardly are provided on a lower surface of the panel at positions corresponding to the position-holding projecting member, these position-holding recesses are located at a circumference of a circle, and an axis of the annular projecting portion passes through a center of the circle.

7. The automatic inflation pump according to the claim 1, wherein a fixing cap is sleeved on the free end of the driving stem, and the end of the spring located at the free end of the driving stem abuts against the fixing cap.

8. The automatic inflation pump according to claim 1, wherein the sealing device further comprises an air sealing rubber ring and a fixing bracket for fixing the air sealing rubber ring at the outside of the air outlet, and the air sealing plate is located at the outside of the air sealing rubber ring.

9. The automatic inflation pump according to claim 1, wherein a cross-shaped frame is provided at a center of the air outlet and is connected with the air outlet, and an annular position-holding ring is provided at a center of the cross-shaped frame.

* * * * *